US008209889B2

(12) United States Patent
Lanser

(10) Patent No.: US 8,209,889 B2
(45) Date of Patent: Jul. 3, 2012

(54) OPERATOR PROPELLED AND/OR GUIDED PORTABLE TRENCHER

(76) Inventor: Jerry L. Lanser, Longmont, CO (US)

( * ) Notice: Subject to any disclaimer, the term of this patent is extended or adjusted under 35 U.S.C. 154(b) by 0 days.

(21) Appl. No.: 12/802,900

(22) Filed: Jun. 16, 2010

(65) Prior Publication Data

US 2011/0119966 A1 May 26, 2011

Related U.S. Application Data

(63) Continuation-in-part of application No. 12/592,079, filed on Nov. 20, 2009.

(51) Int. Cl.
*E02F 3/14* (2006.01)

(52) U.S. Cl. ..... 37/465; 37/462; 37/355; 37/362; 299/34.01

(58) Field of Classification Search ..... 37/465, 37/462, 352, 353, 355, 362, 363, 380; 299/29, 299/34.01, 34.08, 34.12, 76, 78
See application file for complete search history.

(56) References Cited

U.S. PATENT DOCUMENTS

| | | | | | |
|---|---|---|---|---|---|
| 1,398,195 | A | * | 11/1921 | Liggett | 37/462 |
| 1,767,417 | A | * | 6/1930 | Weber | 37/352 |
| 2,817,167 | A | * | 12/1957 | Barber | 37/352 |
| 2,828,557 | A | * | 4/1958 | Brown | 37/363 |
| 2,835,055 | A | * | 5/1958 | Hermes | 37/363 |
| 2,859,544 | A | * | 11/1958 | Evans | 37/352 |
| 2,888,757 | A | * | 6/1959 | Sheen | 37/352 |
| 2,990,631 | A | * | 7/1961 | Brown | 37/363 |
| 3,028,693 | A | * | 4/1962 | Malzahn | 37/363 |
| 3,319,365 | A | * | 5/1967 | Perry et al. | 37/94 |
| 3,419,975 | A | * | 1/1969 | MacDonald | 37/375 |
| 3,508,616 | A | * | 4/1970 | Hubbard | 172/40 |
| 3,754,341 | A | * | 8/1973 | Caldwell et al. | 37/352 |
| 3,834,049 | A | * | 9/1974 | Bond | 37/355 |
| 4,195,427 | A | | 4/1980 | Lanham | |
| 4,429,477 | A | * | 2/1984 | Tice et al. | 37/363 |
| 4,958,457 | A | * | 9/1990 | Doskocil | 37/94 |
| 4,979,573 | A | * | 12/1990 | Williamson | 172/15 |
| 5,156,217 | A | * | 10/1992 | Hirata et al. | 172/15 |
| 5,241,946 | A | * | 9/1993 | Yelton et al. | 125/14 |
| 6,151,811 | A | * | 11/2000 | Barreto | 37/352 |
| 6,338,209 | B1 | * | 1/2002 | McClure | 37/142.5 |
| 6,516,542 | B2 | * | 2/2003 | McClure | 37/142.5 |
| 6,651,361 | B1 | * | 11/2003 | Porter et al. | 37/355 |
| 6,766,601 | B2 | * | 7/2004 | Dickins | 37/363 |
| 7,096,609 | B2 | | 8/2006 | Bainter | |
| 7,096,970 | B1 | * | 8/2006 | Porter et al. | 172/42 |
| 7,469,694 | B2 | * | 12/2008 | Howard et al. | 125/13.01 |

OTHER PUBLICATIONS

Ditchwitch, Trenchers & Plows, www.ditchwitch.com.
Earthmoving.com, Trencher Compact, 8105 "Bantam", www.earthmoving.com.au/trencher_compact.htm.
Earthmoving.com, Trencher Heavy-Duty, 8102 "HTHD", www.earthmoving.com.au/trencher_heavy.htm.

* cited by examiner

*Primary Examiner* — Thomas Beach
*Assistant Examiner* — Matthew Buck
(74) *Attorney, Agent, or Firm* — Harold A. Burdick

(57) ABSTRACT

An operator propelled and/or guided portable trencher is disclosed having a wheeled carriage with an operator manipulable handle bar mounted thereat. The carriage includes a wheel mounting base assembly and a drive frame assembly pivotably connected to each other. A trenching chain assembly is mounted to the drive frame assembly and has a chain maintained at a multi-sprocket chain guide. One sprocket of the chain guide is movably mounted and biased to tension the chain while allowing sprocket movement to partially relieve chain tension during chain use in case of debris entrainment at the chain. An operator manipulable support is connected with the mounting base assembly and is engageable at structure at the drive frame assembly providing operator selection of pivotable location of the drive frame assembly relative to the wheel mounting base assembly during trencher storage and use.

17 Claims, 14 Drawing Sheets

OPERATOR PROPELLED AND/OR GUIDED PORTABLE TRENCHER

RELATED APPLICATION

This application is a continuation-in-part of now pending U.S. patent application Ser. No. 12/592,079 filed Nov. 20, 2009 by the inventor herein and entitled "TRENCHING CHAIN".

FIELD OF THE INVENTION

This invention relates to trench digging apparatus, and, more particularly, relates to portable, motor driven trenchers.

BACKGROUND OF THE INVENTION

Motorized trenching apparatus are widely utilized in a variety of construction industries for formation of deep, wide, and often extensive trenches. Most such trenchers are dedicated vehicular machinery (see, for example, U.S. Pat. No. 4,195,427) or large complex attachments for plows, tractors, loaders and the like (see, for example, U.S. Pat. No. 7,096, 609).

In the field, however, various contractors often need only small, narrow trenches created with a minimum of surface/soil disturbance. For example, electrical and telecommunications contractors often need to install small (½ to ¾ inch) PVC conduits under concrete slabs such as factory, warehouse or store floors and the like. Likewise, plumbers often run small water lines under slabs for waste pipe, supply lines, LP lines, and the like. Usually trenches for such purposes need only be a few inches deep. Larger trenching or digging machinery is thus typically impractical for these installations, and manual trench formation is often made very difficult due to worksite soil compaction (requiring pickaxes and the like to form the trench).

Narrow, shallow but extensive trenching is also utilized by landscape contractors for installation or replacement of sprinkler systems and low voltage landscape lighting. Small trenches can also be utilized by landscaping installers for vinyl edging and erosion cloth installation or replacement. Large trenching units are again typically impractical for use in many such installations (retrofit installations in existing yards and existing installation repair, for example). Heretofore utilized trenchers are not readily maneuverable in small areas and are difficult to utilize when barriers or impediments such as building walls, landscaping and/or fences are near the trench being created. Curved trenches are also difficult for these larger machines to accommodate.

Maintenance of such machinery is involved and extensive, and the ability to perform on-site trenching chain maintenance or replacement is limited by chain size and/or repair tool requirements (the chain being the main wear item in such machinery, maintenance thereof is common). Additionally, the bulk and power of such heretofore known trenching machinery requires trained operators and great care for safe use. The low speed operation of most such machinery means that material removed from the trench is often more difficult to backfill.

Moreover, moving heretofore known trenching machinery from one site to another usually requires trailering, and storage and maintenance of such machinery requires large yard areas, making their maintenance and use impractical for many contractors and/or for smaller jobs. Do-it-yourself and contractor rental facilities would also benefit from smaller and more readily transportable and storable trenching units.

Thus, a trencher design for small (narrow and shallow) trench formation that is easy to use and store, and that is readily portable could be utilized.

SUMMARY OF THE INVENTION

This invention provides an operator propelled and/or guided portable trencher that is particularly well adapted for formation of narrow and relatively shallow trenches. The trencher is highly maneuverable in small and/or crowded work areas, is capable of tightly curved trench formation, operates at a high speed, and requires little operator training for safe operation. Trencher maintenance and chain replacement are performed quickly and easily, and trencher transport and storage requires little or no extra gear or facilities.

The operator guided portable trencher of this invention includes a wheeled carriage having an operator handle bar mounted thereat. A trenching chain assembly is mounted at the carriage, the assembly including a chain and a multi-sprocket chain guide. A first sprocket of the chain guide is movably mounted and biased to tension the chain while still allowing sprocket movement to partially relieve chain tension during chain use in case of debris entrainment adjacent to the chain guide/chain interface.

The carriage includes a wheel mounting base assembly and a drive frame assembly pivotably connected at first ends to each other, the handle bar mounted adjacent to the first ends. A plurality of wheels is mounted at the mounting base assembly. An operator manipulable support is connected with one or the other of the mounting base assembly and the drive frame assembly, the support spaced from the first ends thereof. The support includes multiple support locations engageable by an engagement structure at the other of the mounting base assembly and the drive frame assembly as may be selected by an operator of the trencher. In this manner, operator selection of pivotable location of the drive frame assembly relative to the wheel mounting base assembly during trencher storage and use is provided.

The trenching chain assembly further includes a chain drive motor at the drive frame assembly operationally associated with the chain guide. The chain guide preferably includes a chain bar and a pivotable sprocket mount with the first sprocket maintained thereat, the chain bar having second and third sprockets mounted adjacent to opposite ends thereof. The sprocket mount is pivotably mounted at the drive frame assembly and biased to selectively tension the chain during chain use as provided above.

It is therefore an object of this invention to provide a compact portable trencher.

It is another object of this invention to provide an easy to use, operator propelled and/or guided trencher.

It is still another object of this invention to provide a relatively small, light weight trencher for small (narrow and shallow) trench formation.

It is yet another object of this invention to provide a trencher having a trenching chain that simply and quickly removable, replaceable and maintainable at a worksite.

It is still another object of this invention to provide an operator propelled and/or guided trencher that is highly maneuverable and thus useful in small areas and adjacent to barriers or other impediments.

It is yet another object of this invention to provide a trencher that can be readily maneuvered to create tightly curved trenches.

It is another object of this invention to provide a trencher that requires little training to utilize and that is relative safe to use.

It is still another object of this invention to provide a trencher that runs at a high speed thus providing removed material with finer particle size that is easier to backfill.

It is yet another object of this invention to provide an operator guided trencher including a wheeled carriage, an operator handle bar mounted with the carriage, and a trenching chain assembly mounted at the carriage, the assembly including a chain and a multi-sprocket chain guide, a first sprocket of the chain guide movably mounted and biased to tension the chain during chain use while allowing sprocket movement to partially relieve chain tension during chain use in case of debris entrainment at the chain.

It is another object of this invention to provide a portable trencher that includes a carriage having a wheel mounting base assembly and a drive frame assembly pivotably connected to each other adjacent to first ends of each, a plurality of wheels mounted at the mounting base assembly, an operator manipulable support connected with one of the mounting base assembly and the drive frame assembly spaced from the first ends thereof and having multiple support locations thereat, the other of the mounting base assembly and the drive frame assembly having engaging means thereat for association with any operator selected one of the support locations of the support thereby providing operator selection of pivotable location of the drive frame assembly relative to the wheel mounting base assembly during trencher storage and use, a trenching chain assembly mounted on the drive frame assembly, the chain assembly including a trenching chain mountable at a chain guide and a chain drive motor operationally associated with the chain guide, and an operator handle bar mounted at the carriage adjacent to the first ends of the mounting base assembly and the drive frame assembly.

It is still another object of this invention to provide an operator propelled and guided portable trencher that includes a carriage having a wheeled mounting base assembly and a drive frame assembly pivotably connected to each other adjacent to first ends of each, a trenching chain assembly mounted at the drive frame assembly of the carriage, the trenching chain assembly including a chain and a chain guide, the chain guide having a chain bar and a pivotable sprocket mount with a first sprocket maintained thereat, the chain bar having second and third sprockets mounted adjacent to opposite ends thereof, the sprocket mount pivotably mounted at the drive frame assembly and biased to tension the chain during chain use while allowing movement of the first sprocket to partially relieve chain tension during chain use in case of debris entrainment adjacent to the chain, and a handle bar mounted at the carriage adjacent to the first ends of the mounting base assembly and the drive frame assembly;

With these and other objects in view, which will become apparent to one skilled in the art as the description proceeds, this invention resides in the novel construction, combination, and arrangement of parts substantially as hereinafter described, and more particularly defined by the appended claims, it being understood that changes in the precise embodiment of the herein disclosed invention are meant to be included as come within the scope of the claims.

BRIEF DESCRIPTION OF THE DRAWINGS

The accompanying drawings illustrate a complete embodiment of the invention according to the best mode so far devised for the practical application of the principles thereof, and in which.

DESCRIPTION OF THE INVENTION

Figure 1:
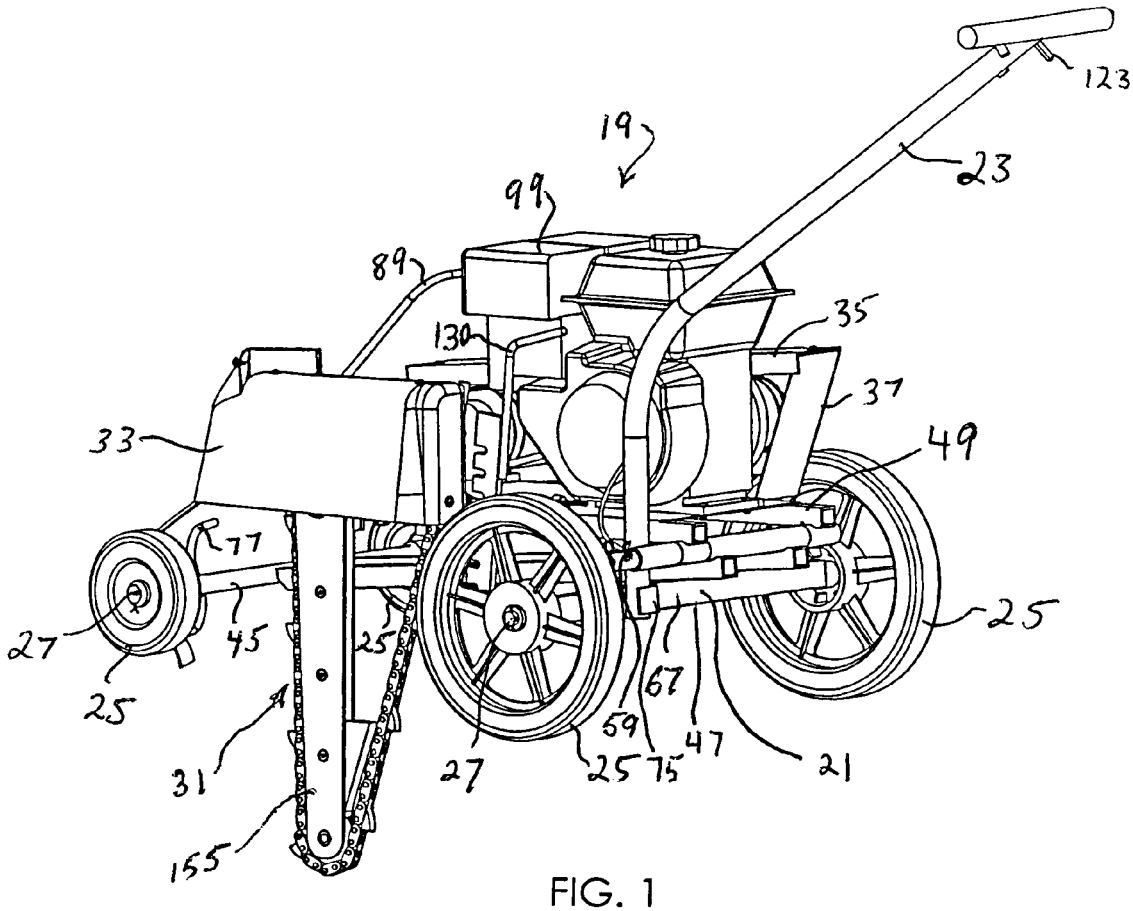
FIG. 1 is a perspective view of a currently preferred embodiment of a portable trencher in accord with this invention.
Figure 2:
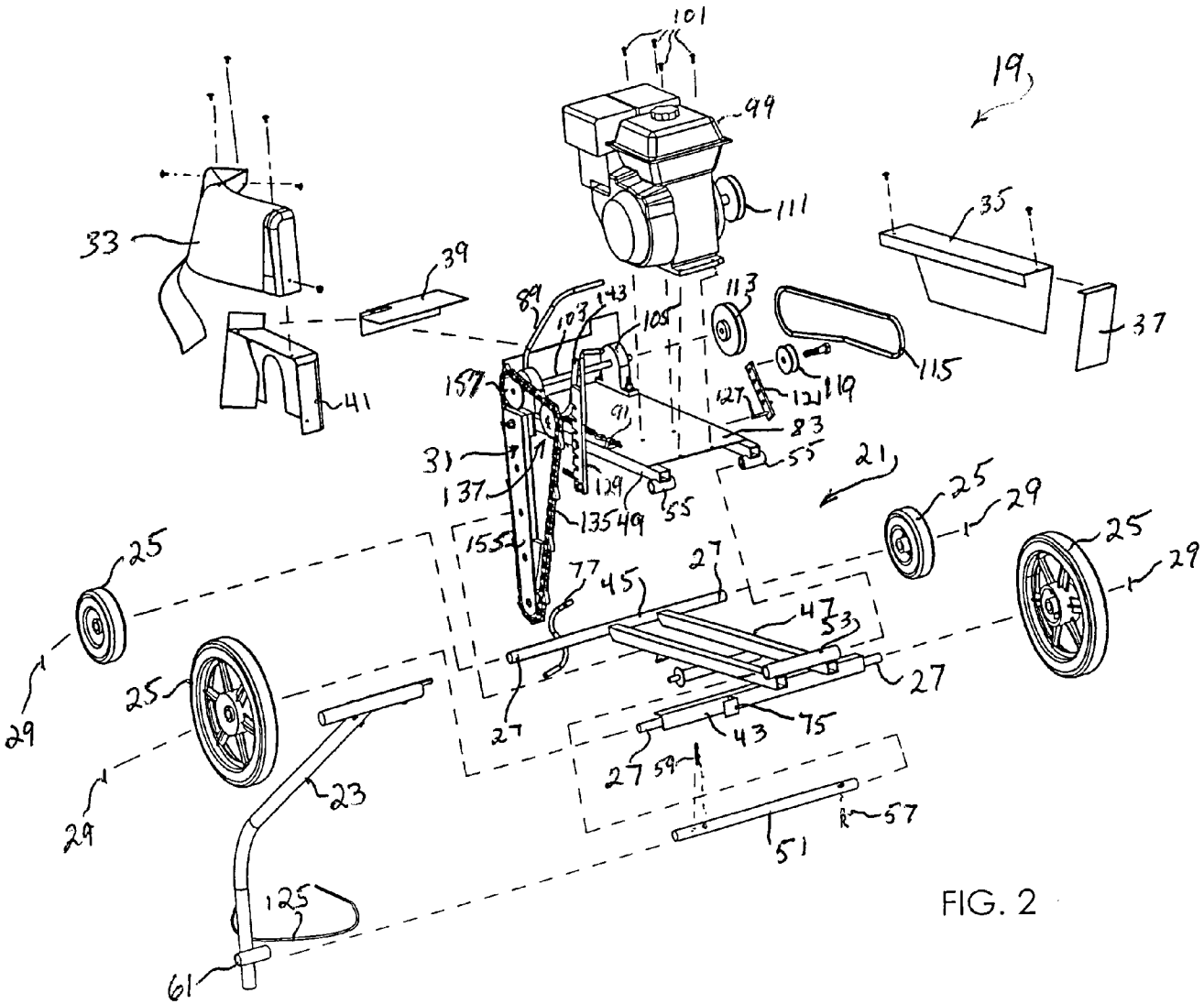
FIG. 2 is an exploded view of the trencher of FIG. 1.
Figure 3:
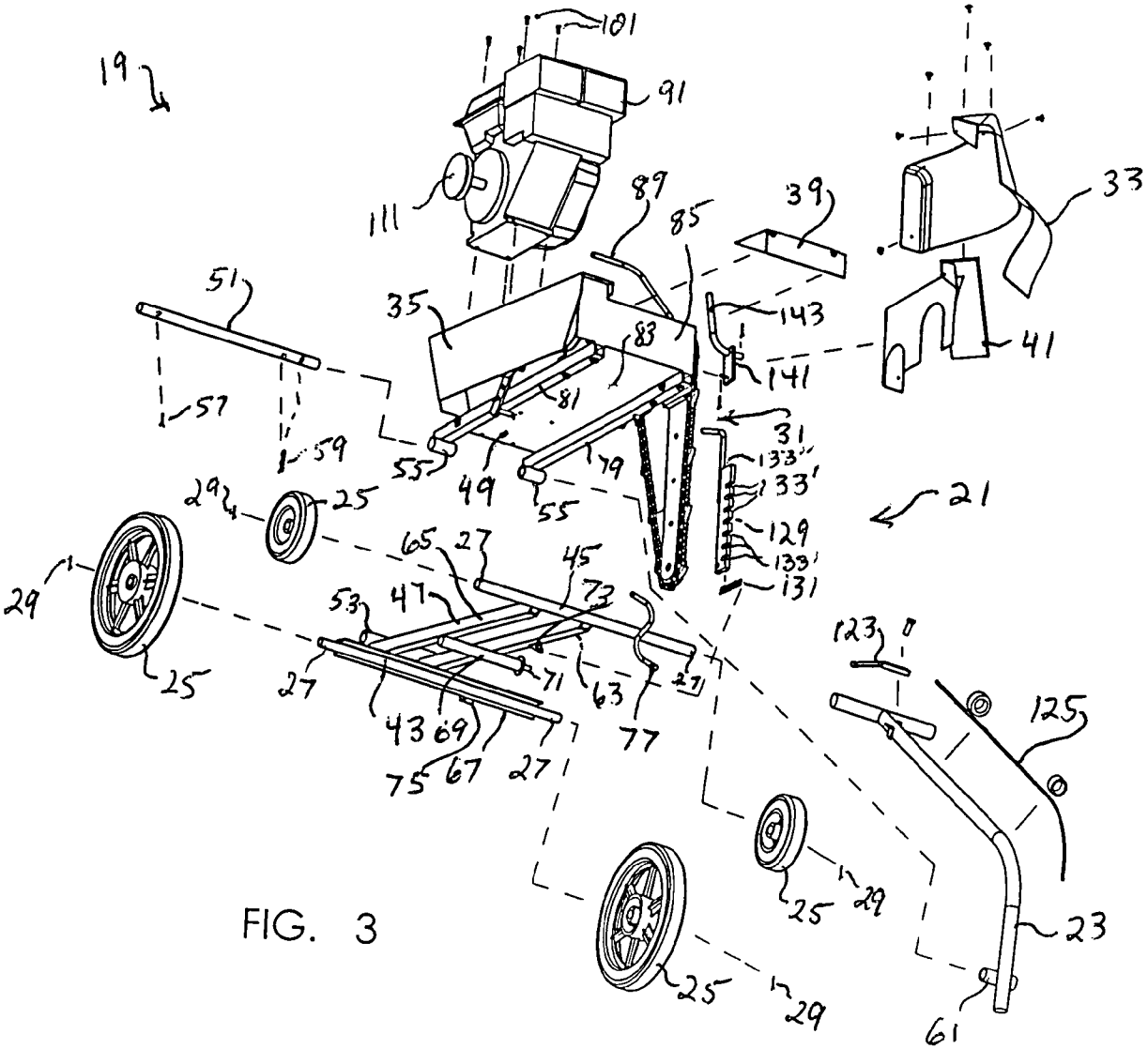
FIG. 3 is a second exploded view of the trencher of FIG. 1.

A currently preferred embodiment of the trencher of this invention is illustrated in the FIGURES. Turning to FIGS. 1 through 7, trencher 19 includes carriage 21 having operator manipulable handle bar 23 extending rearwardly from one end thereof. A plurality of wheels 25 are rotatably mounted on integrated internal bearings in turn mounted on spindles 27 (and held in place using known mechanisms such as nuts, locking ring washers, or, as shown, cotter pins 29). Trenching chain assembly 31 is maintained at carriage 21 as more fully discussed hereinbelow, and flexible material hood 33 is maintained at the front of carriage 21 over chain assembly 31 for directing outflow of materials being removed during trenching operations and safeguarding the operator. Hood 33 is sized and configured so that it remains in place regardless of selected positioning of the various carriage 21 subassemblies as discussed hereinafter, thereby accommodating subassembly relative movement. Various sheet metal guards, covers and mounts 35, 37, 39 and 41 are provided as may be necessary and as shown in FIGS. 1 through 3 for covering moving parts (belt covers 35 and 37, for example), shielding the operator from debris (guard 39, for example), and locating and mounting other parts (hood locator and mount 41, for example).

Spindles 27 are located at the ends of rearward first end frame member 43 and forward second end frame member 45 of a wheel mounting base assembly 47 of carriage 21. Drive frame assembly 49 is pivotably connected at its rearward first end with the rearward first end of assembly 47 using main pivot shaft 51 through journals 53 and 55 at each of assemblies 47 and 49, respectively (see FIGS. 2 THROUGH 4 and 15). This assemblage is retained by cotter pin 57, cotter pin 59 being selectively positionable to retain and locate journal 61 at the end of handle bar 23 on shaft 51, thus enabling handle bar positioning in either an operational or stored configuration (see FIGS. 1 and 15).

Figure 4:
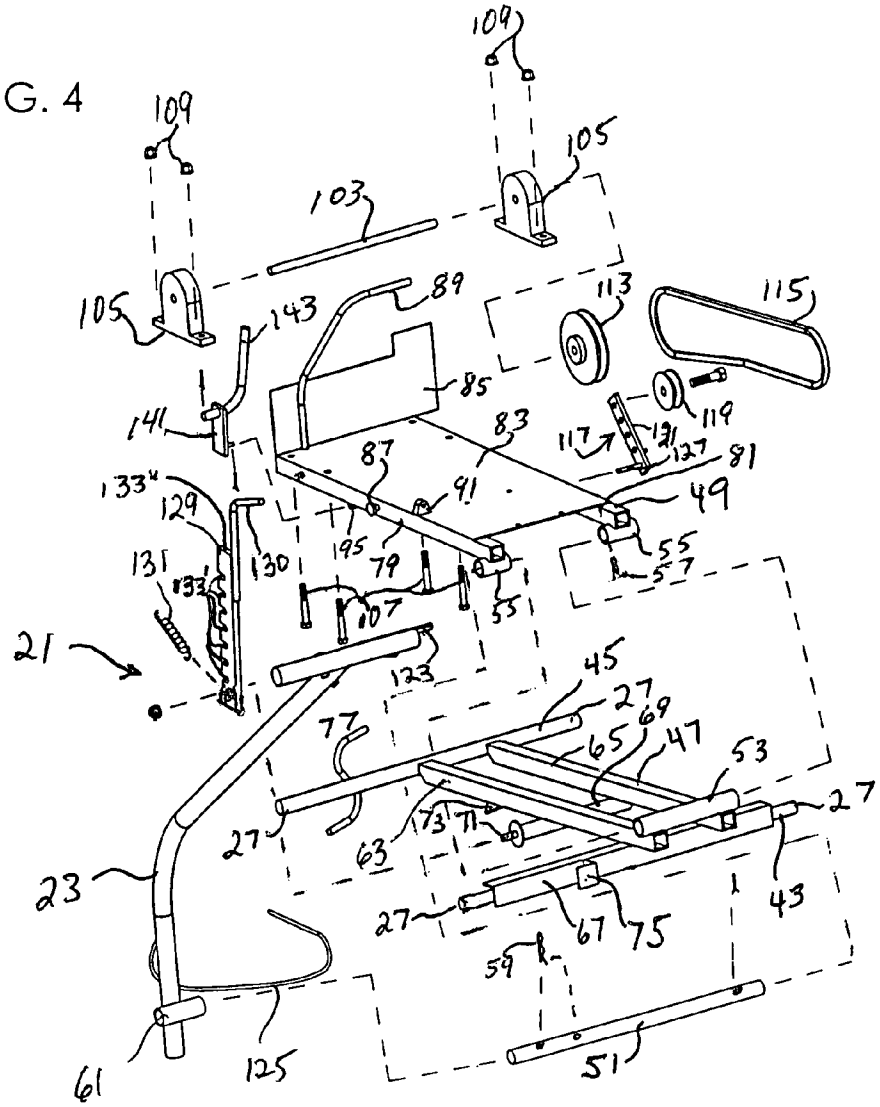
FIG. 4 is a partial exploded view of the trencher carriage including wheel mounting base and drive frame assemblies of the trencher of FIG. 1.
Figure 5:
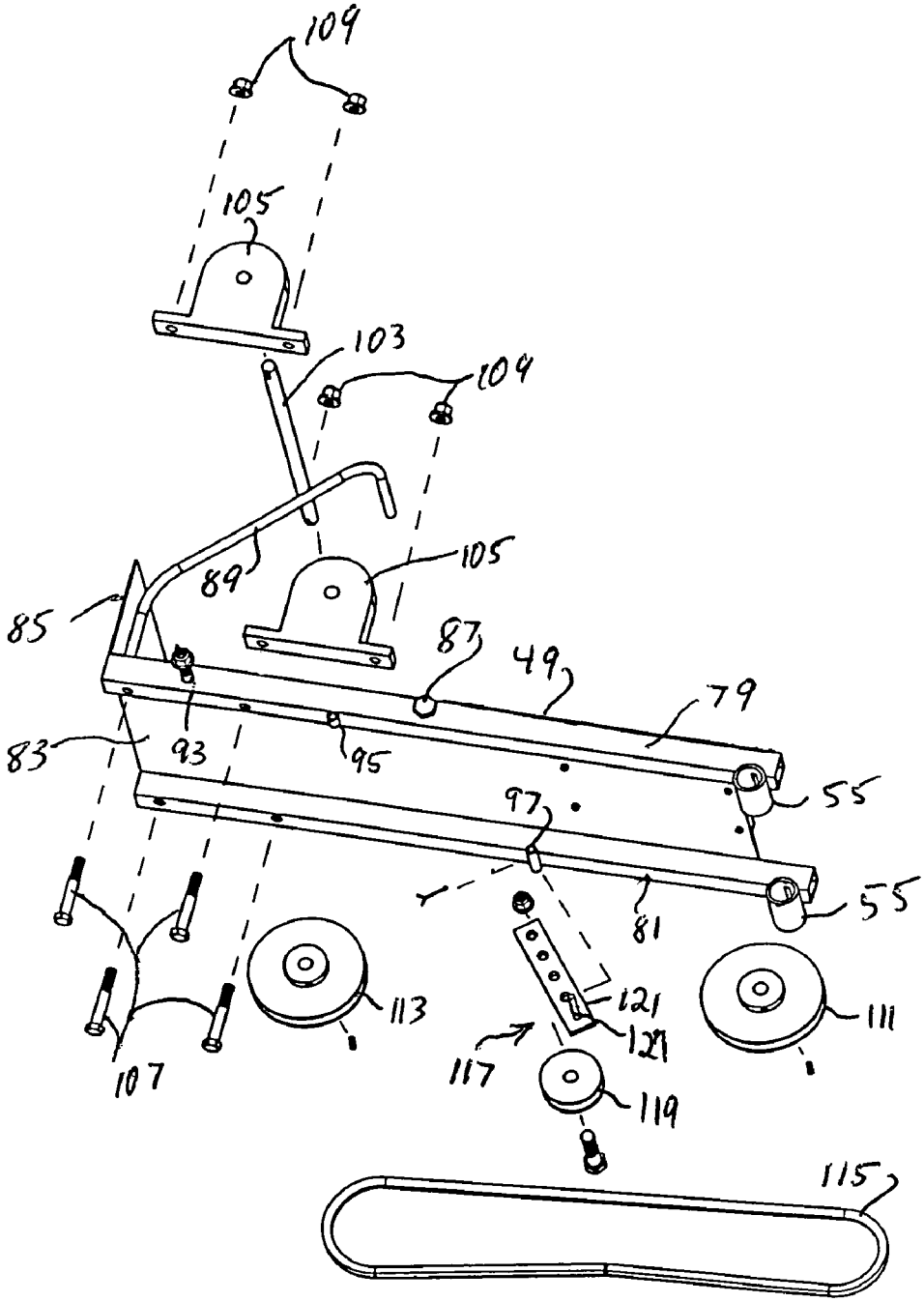
FIG. 5 is partial exploded view further illustrating the drive frame assembly shown in FIG. 4.

Mounting base assembly 47 is shown in greater detail in FIGS. 3 and 4 and comprises a welded frame formed by lateral frame tubes 63 and 65 and rearward angle iron frame member 67. Member 67 is welded to frame member 43 and tubes 63 and 65 are welded to frame member 45. Journal 53 is welded between tubes 63 and 65, as is pivot connection support rod 69 having threaded pivot connection 71 at one end thereof. Spring retaining clip 73 is welded at the bottom of tube 63, and handle retaining clip 75 is welded at the rear of member 67 to hold handle bar 23 when at the operational position (see FIG. 1). Hood positioning and spacing iron 77 is welded to member 45 to assure clearance of hood 33 from chain assembly 31 (see FIG. 1).

Drive frame assembly 49 (see FIGS. 3 through 7) includes lateral frame tubes 79 and 81 each having one of journals 55 welded at the rearward first ends thereof. Mounting platform 83 is mounted to tubes 79 and 81 and includes front guard plate 85 at the forward end thereof. Support engaging dog 87 is secured at tube 79. Hoist handle 89 is welded or otherwise affixed at guard plate 85. Spring adjustment retainer eye 91 (FIGS. 4 and 6) is welded or otherwise affixed at platform/tube 83/79. Threaded mounting bolt 93 is secured to or through frame tube 79 as is pivot sprocket mount receiving tube 95 (see FIG. 5). Drive actuator mounting tube 97 is secured at the bottom of frame tube 81.

Figure 10:
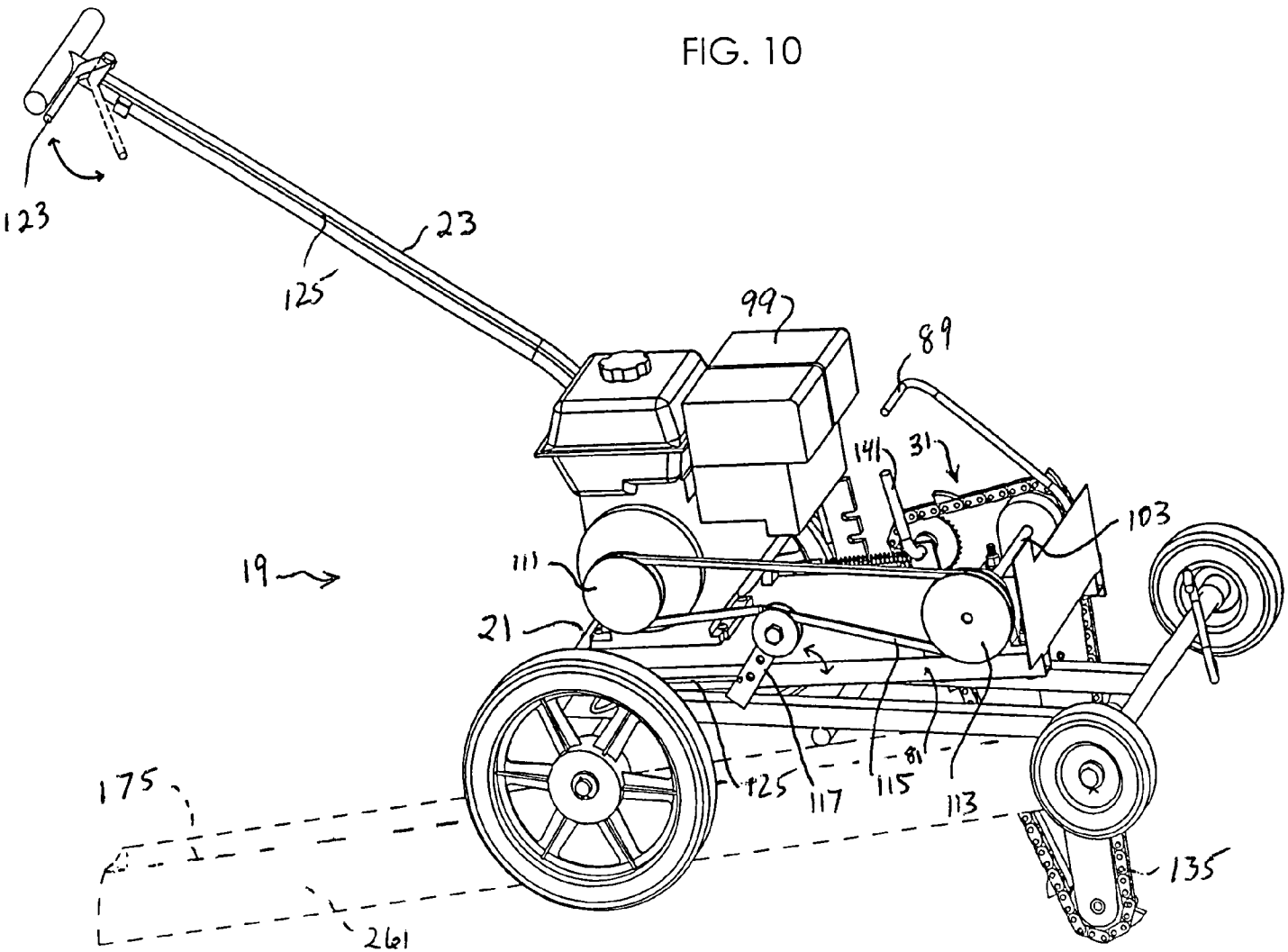
FIG. 10 through 15 illustrate operation of the trencher of this invention.

As best shown in FIGS. 2 through 6, motor 99 (a gasoline or electric motor, for example) is mounted on platform 83 using bolts 101. Trenching chain guide drive linkage shaft 103 is mounted through bearing/journals 105 mounted on platform 83 by bolts 107 and nuts 109. Output drive pulley 111 is held on the motor 99 output shaft in a conventional manner, and shaft drive pulley 113 is likewise secured to shaft 103. Drive belt 115 links the two pulleys, and pivoting drive actuator 117, including pulley 119 rotatably bolted at one end of pivot arm 121, engages and disengages motor driving force to shaft 103 responsive to operator control lever 123 movement by an operator causing pulley 119 tensioning and tension release of driver belt 115. Lever 123 is connected for operation of pivot arm 121 using a standard cable and sheath linkage 125, the sheath anchored at one end at handle bar 23 and at the opposite end at frame tube 81 and the cable connected between lever 123 and pivot arm 121. Pivot arm 121 thus pivots on pivot pin 127 in tube 97 responsive to lever actuation to tension and release belt 115 via contact by pulley 119 (see also FIG. 10). Motor 99 is selected to provide a relatively high chain drive shaft 103 rotational output speed (between 1500 and 2000 rpm).

Figure 12:
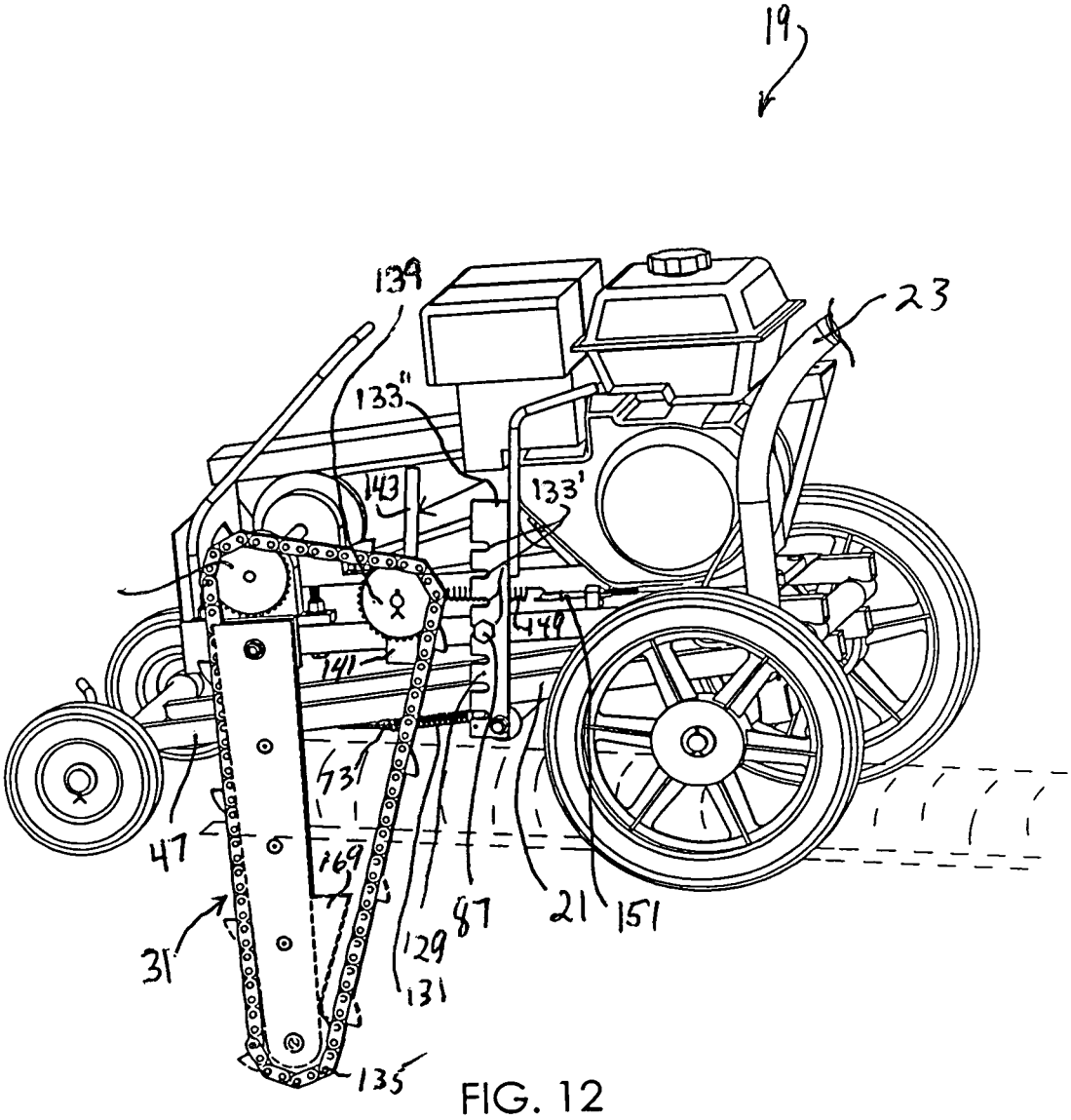
Figure 13:
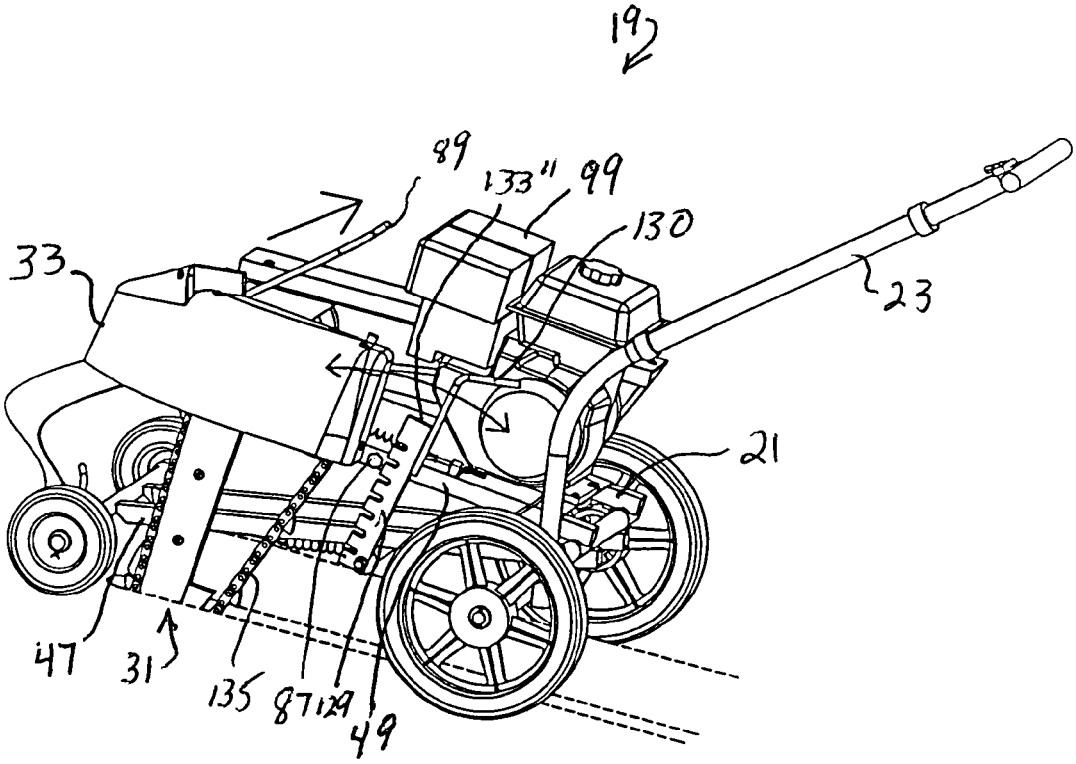
Figure 14:
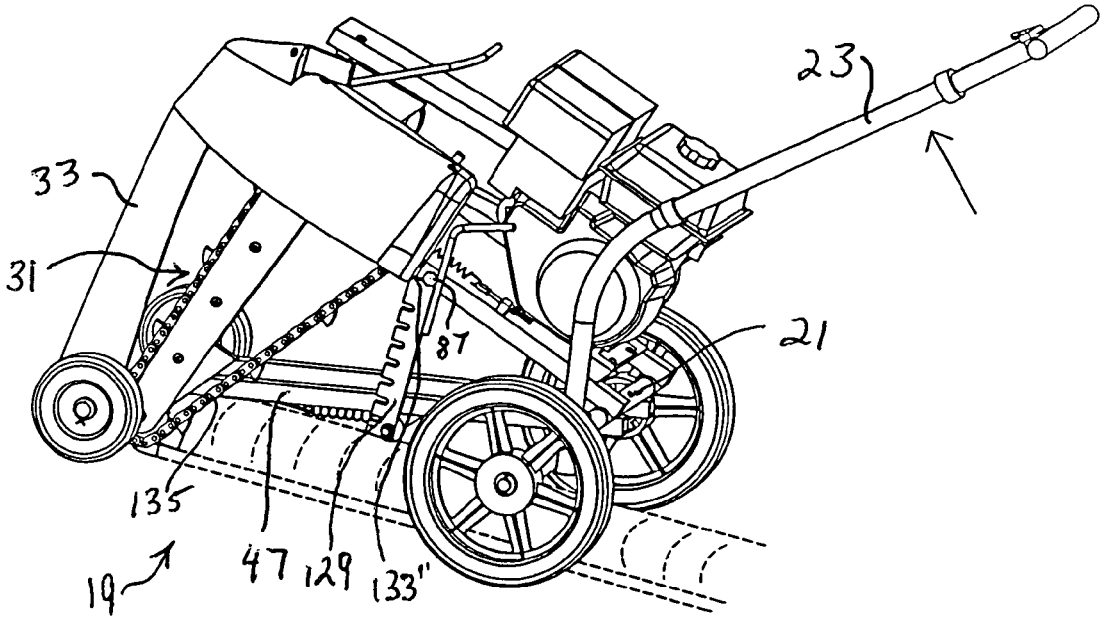

Operator manipulable support 129 includes handle 130 and is pivotably secured on threaded pivot connection 71 of support rod 69 (using a matable nut) and is biased toward engagement with dog 87 by biasing spring 131 connected between support 129 and clip 73 (best shown in FIGS. 3, 4 and 12). Support 129 has multiple graduated support locations 133 defined therealong, including a plurality of intermediate support locations 133' for selection of trenching chain cutting depth and a storage support location 133" at the top thereof.

Figure 6:
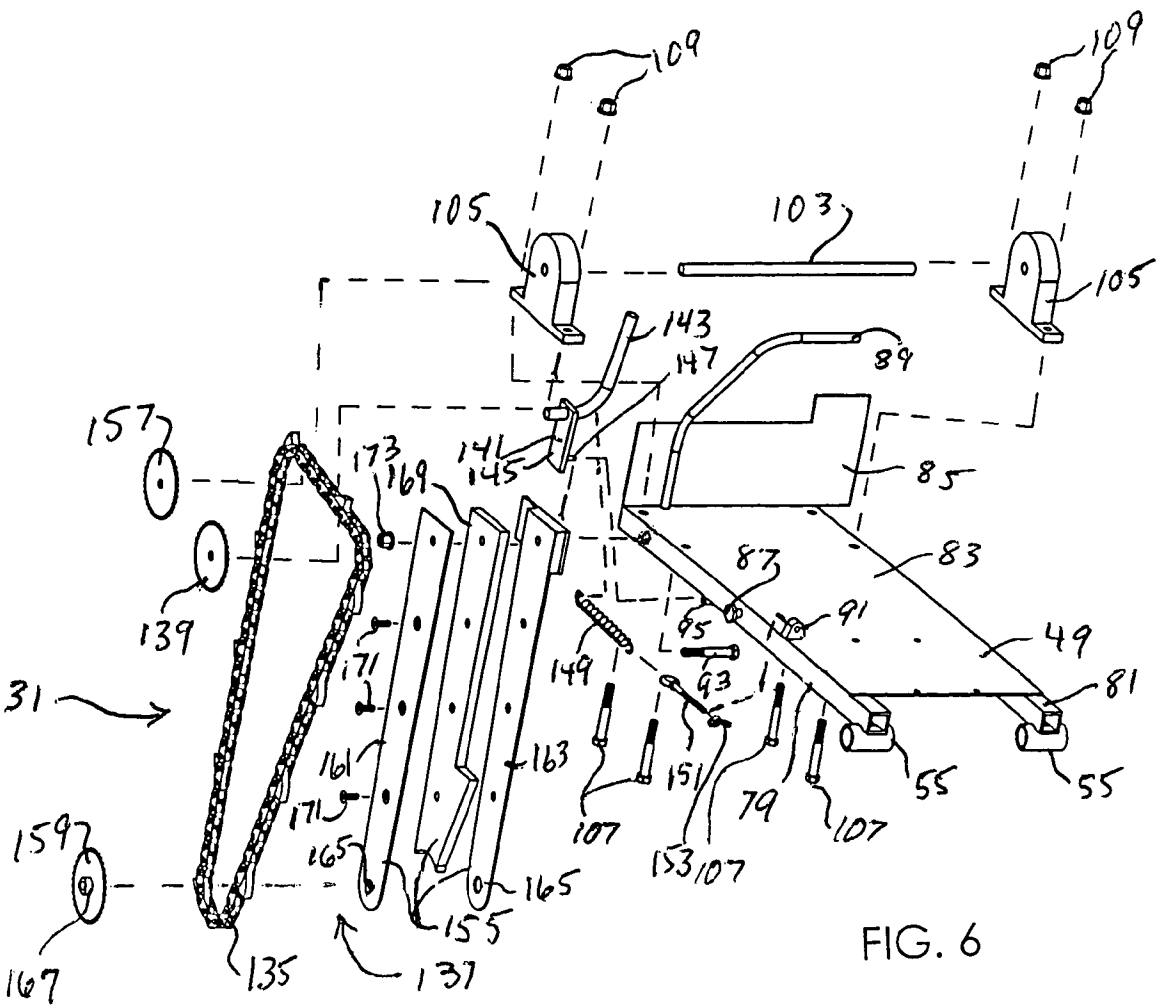
FIG. 6 is an exploded view showing the drive frame assembly and trenching chain guide bar assembly of the trencher of FIG. 1.
Figure 7:
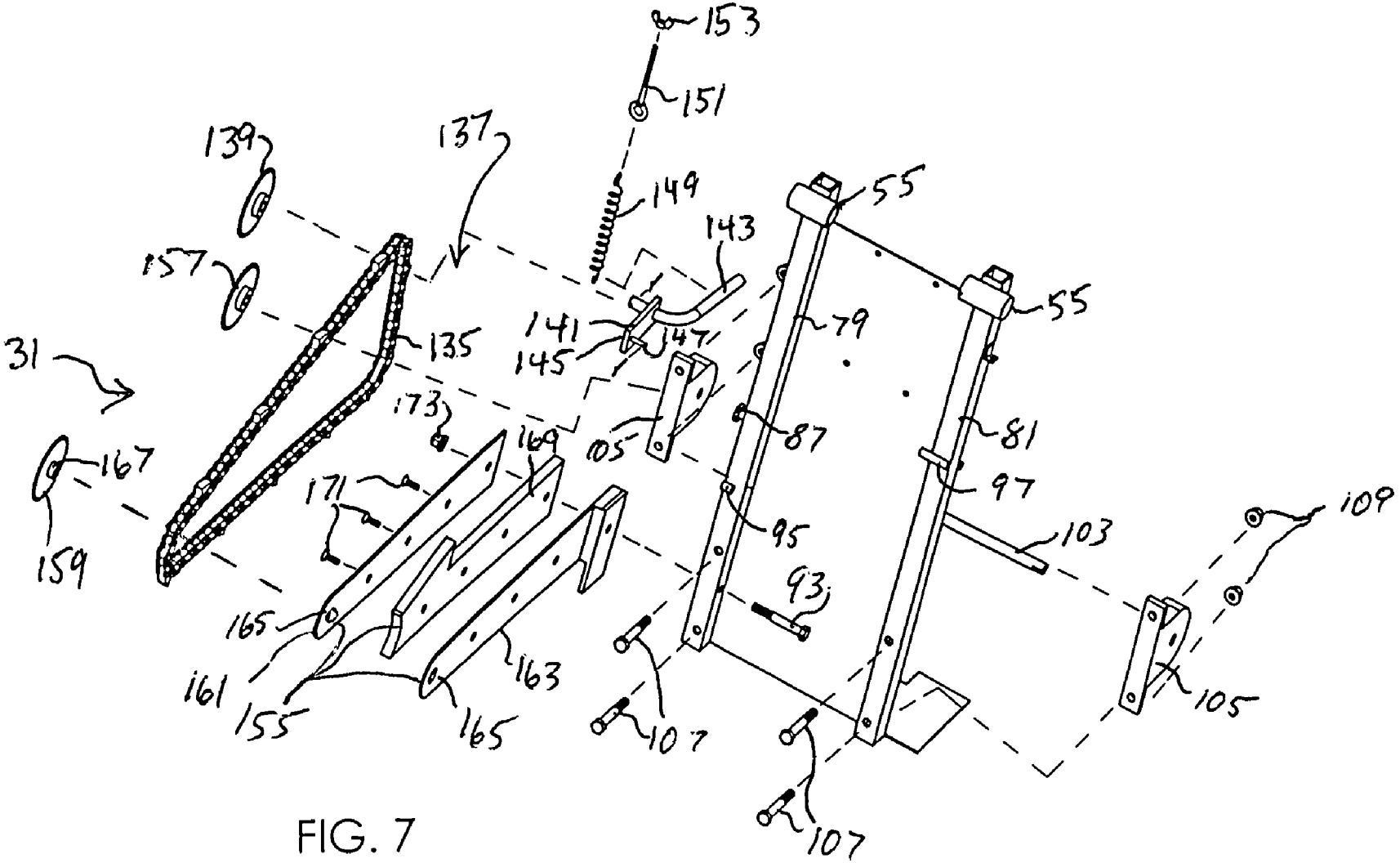
FIG. 7 is a second perspective of the exploded view of FIG. 6.

Trenching chain assembly 31 is best illustrated in FIGS. 2, 6 and 7. Assembly 31 includes chain 135 and multi-sprocket chain guide 137. By multi-sprocket it is meant that at least two sprockets, and preferably three or more, are utilized in the assembly. First sprocket 139 (an idler sprocket) of guide 137 is movably mounted and biased on pivotable sprocket mount 141 to tension the chain during chain use while allowing sprocket movement to partially automatically relieve chain tension during chain use in case of debris entrainment (rocks or the like) at or adjacent to the chain. Sprocket mount 141 includes manually actuatable handle 143 having sprocket 139 rotatably mounted on one end thereof thus allowing operator movement of sprocket 139 against bias for chain tension relief (to service, replace or clear the chain, for example). Handle 143 is secured at pivot arm 145 pivotable in tube 95 on pin 147. Mount 141 is biased to selectively tension chain 135 by spring 149 connected between spring tension adjusting bolt 151 mounted through retainer eye 91 and handle 143, tension adjustment made by tightening or loosening wing nut 153 secured at the opposite side of eye 91 on bolt 151.

Chain guide 137 further includes chain bar 155 having second and third sprockets 157 and 159 rotatably mounted adjacent to opposite ends thereof. Drive sprocket 157 is mounted to drive shaft 103. Idler sprocket 159 is journaled between chain bar mounting plates 161 and 163 through openings 165 thereof receiving opposite facing annular hubs 167 of sprocket 159. Center chain guide plate 169 is made of self lubricating plastic material (for example, ultra-high molecular weight polyethylene) and is mounted between mounting plates 161 and 163 using screws 171 to minimize debris entrainment at the chain and the chain guide interface during trenching operations. The assembled chain bar 155 is mounted to tube 79 using bolt 93 and nut 173.

Figure 8:
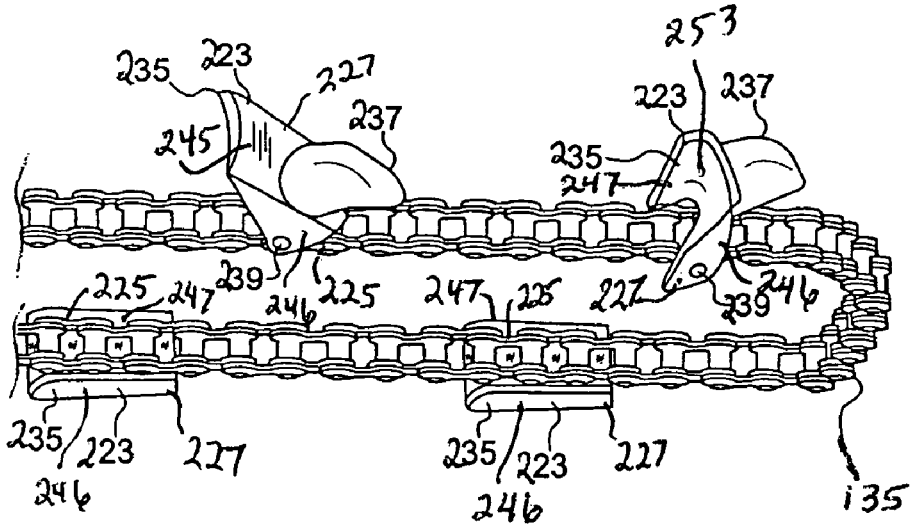
FIG. 8 is a partial perspective view of one type of trenching chain particularly well adapted to the trencher of this invention.
Figure 9:
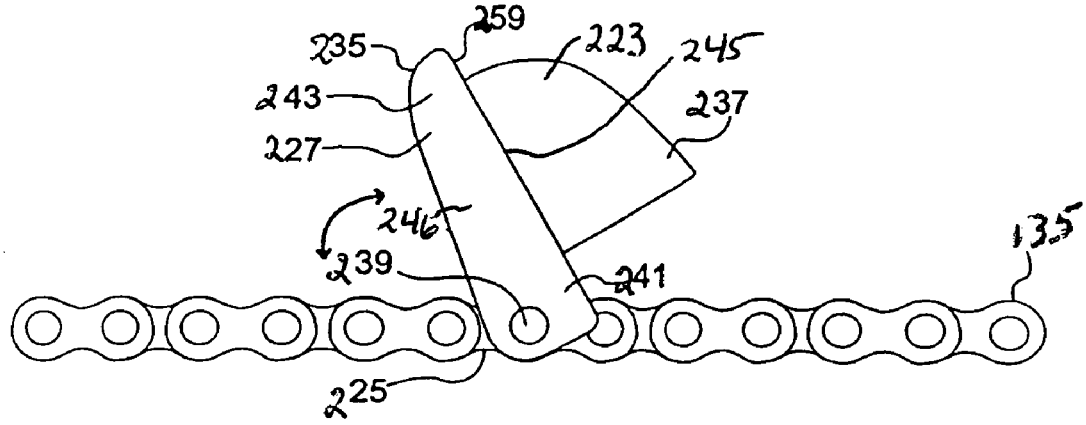
FIG. 9 is a side view of the chain of FIG. 8.

Turning now to FIGS. 8 and 9, while any known trenching chain type suitably configured and proportioned for a particular use with the trencher described herein could be utilized, a preferred chain embodiment for use herein is illustrated.

Figure 11:
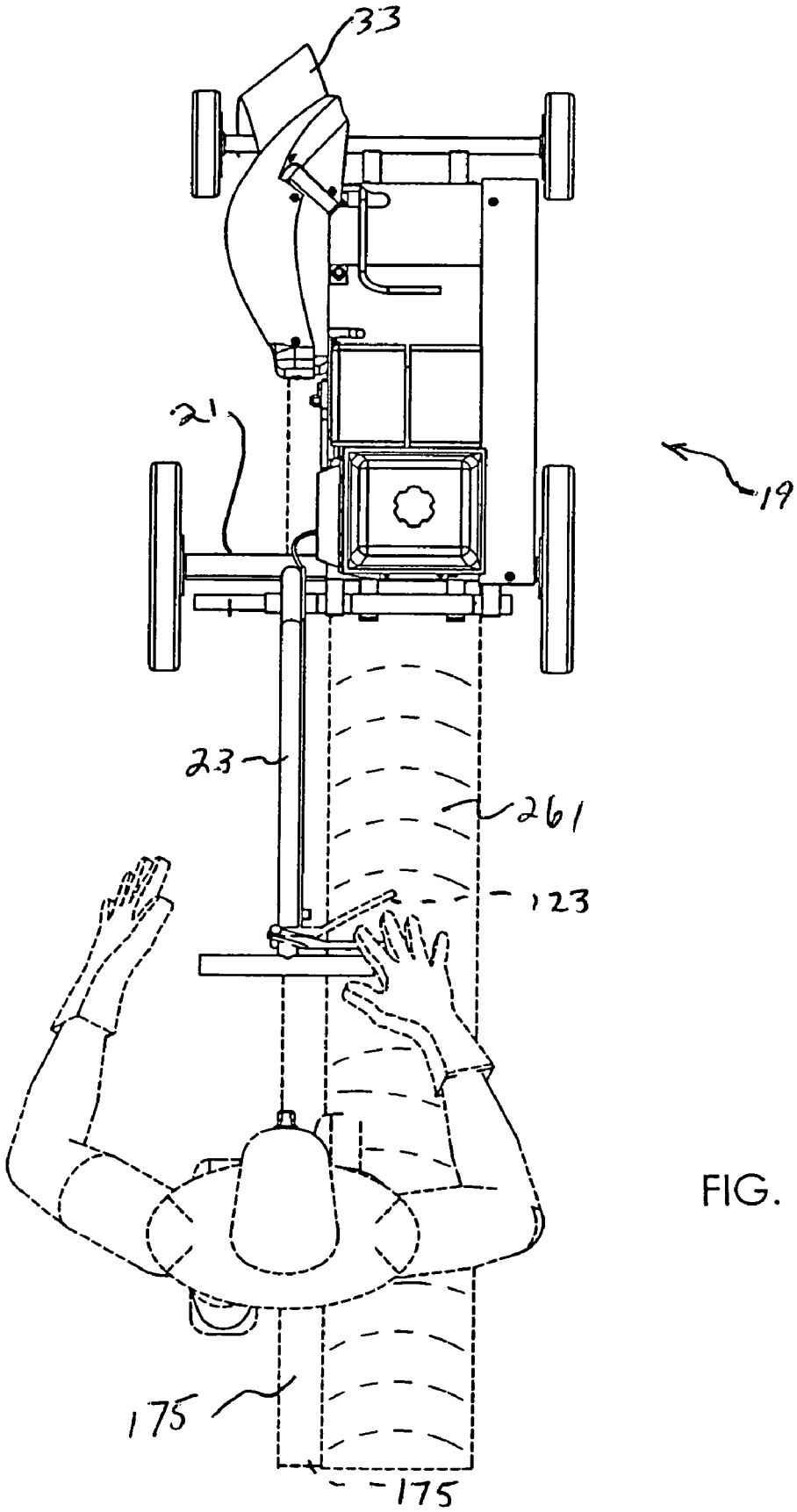

As trencher 19 moves forward astraddle trench 175 being created (see FIGS. 10 and 11), the preferred trencher chain 135 rotating around sprockets 139, 157 and 159 progressively cuts the trench while continuously cleaning (sweeping) dislodged particles from the trench at cutting link combinations as described hereinafter.

Trenching chain 135 includes cutting link combinations 223, each of the cutting link combinations including link body 225 and clip 227. Link body 225 is pivotably joinable with adjacent link bodies at first and second ends in a conventional fashion. At least some of clips 227 include carriage 235 and cutting implement 237. Linkage 239 (herein a welded or press fit linking pin, though other known structures could be utilized both separate from and/or integrated with carriage 235 and/or link body 225) pivotably associates carriage 235 with link body 225 as well, in this configuration, as associating link body 225 with an adjacent link body. Each carriage 235 (and thus clip 227) has end part 241 adapted for pivotable engagement with a link body 225 end (using linkage 239, for example, through openings thereat) so that clip 227 is freely pivotable toward and away from link body 225. Opposite end 243 of carriage 235 is unengaged and freely pivotable.

Carriage 235 includes flat mounting portion 245 between spaced (preferably wedge shaped) sides 246 and 247 each having end part 241 thereat. Cutting implement 237 is secured (welded, bolted or the like, in this embodiment) at the top surface of mounting portion 245, link bearing surface 253 provided opposite the top surface. Sides 246 and 247 are spaced sufficiently to enable freely pivoting movement of link body 225 and adjacent link body or bodies into and out of adjacency and/or contact with link bearing surface 253 of mounting portion 245 therebetween during trenching chain use. Carriage 235 length between opposite ends is preferably greater than link body 225 length (and preferably at least twice the length of body 225 or longer). Cutting implements 237 of clip 227 may be any of various known or conceivable cutting teeth and/or bit (rock/frost, for example) configurations.

Portion 245 is formed (by forging, milling, welding or bending, for example) between wedge shaped spaced sides 246 and 247 along opposite side edges thereof. Clips 227 each have a configuration at opposite end 243 (a broad, flat expanse at the end of the top surface of mounting portion 245, for example) adapted for trench sweeping. While cutting implements 237 are shown herein affixed to every carriage 235 of clips 227, some clips may be provided without cutting implements ("sweeper" clips). Moreover, a sweeper chain can be provided utilizing clips without any cutting implements at all. Trenching chain 135 utilizes a plurality of links 225 joined in an endless chain design together with a plurality of clips 227.

As shown in FIGS. 8 through 10 and 11, as chain 135 is rotated, cutting implements 237 engage the end of trench 175 to move and cut earth thereat. Such engagement causes pivoting of the freely pivotable clips 227 toward chain links 225, the links movable into and out of adjacency and/or contact with carriage bearing surface 253 of mounting portion 245 between sides 246 and 247. As link combinations 223 clear trench 175, clips 227 pivot away from links 225 under force of the rotating chain 135, and are thereby positioned as rotation continues for resilient contact with the bottom of trench 175 to continuously clean/sweep the trench during trenching operations.

The component parts of trenching chain 135 are preferably made of iron or steel and may be cast or milled or otherwise formed (utilizing sheet or angle/channel material, for example). The cutting teeth/bits may include unitary structures or multi-part structures (including, for example, carbide tips). Linkages may be accomplished using steel linking pins (as shown), or may employ linking structure incorporated into any of the linked parts.

Turning now to FIGS. 10 through 15, use of the trencher of this invention is illustrated (for clarity of illustration, hood 33 is not shown in a number of these FIGURES, it being understood that during all trenching operations, the hood should remain attached). When trencher 19 is received at a worksite, handle 23 will be articulated forward in its stored position and assemblies 47 and 49 will be pivoted apart with dog 87 engaged at storage support location 133" of support 129 (see FIG. 15) so that trencher 19 can be free wheeled without chain assembly 31 dragging the ground. Handle 23 is first pivoted rearward, cotter pin 59 removed, and journal 61 slid laterally on main pivot shaft 51 until it abuts one of journals 55. Cotter pin 59 is then replaced.

Motor 99 is preferably started in this configuration, and the trencher is readied at the location to be trenched. When the operator is ready, engagement of lever 123 causes drive actuation and chain 135 begins rotation on guide 137. The operator then releases assembly 49 by grasping handle 130 of support 129 and moving support 129 against bias while holding handle 89. The operator may thus lower assembly 49 into the earth, and trenching begins (see FIG. 10). As formation of trench 175 proceeds, hood 33 directs outflow of materials being removed during trenching operations to a relatively tidy pile 261 running beside trench 175 (see FIG. 11). All propulsion and guidance is in the trencher embodiment shown herein is provided by an operator walking behind and pushing on handle bar 23 to move the trencher forward, turn the trencher, lift the trenching chain assembly and the like. This allows the operator to view and aim to the trench end while simultaneously viewing trench formation. Thus trench cutting leads trencher movement. If lever 123 is released, chain rotation ceases, but the motor continues to run.

As illustrated in FIG. 12, trench depth is controlled by location of dog 87 at an operator selected intermediate support location 133'. Trenching depth can be changed on the fly by changing location of dog 87 along support 129. If, during operations, rocks or debris become entrained between chain 135 and chain bar 155, chain tension is automatically compensated by movement of sprocket 139 against bias. In most cases this will allow the debris to cycle out of chain engagement. If further operations are required at the chain assembly requiring operator intervention, movement of handle 143 to pivot mount 141 will release chain tension allowing any chain manipulation that may be necessary (including chain removal) without use of tools.

Figure 15:
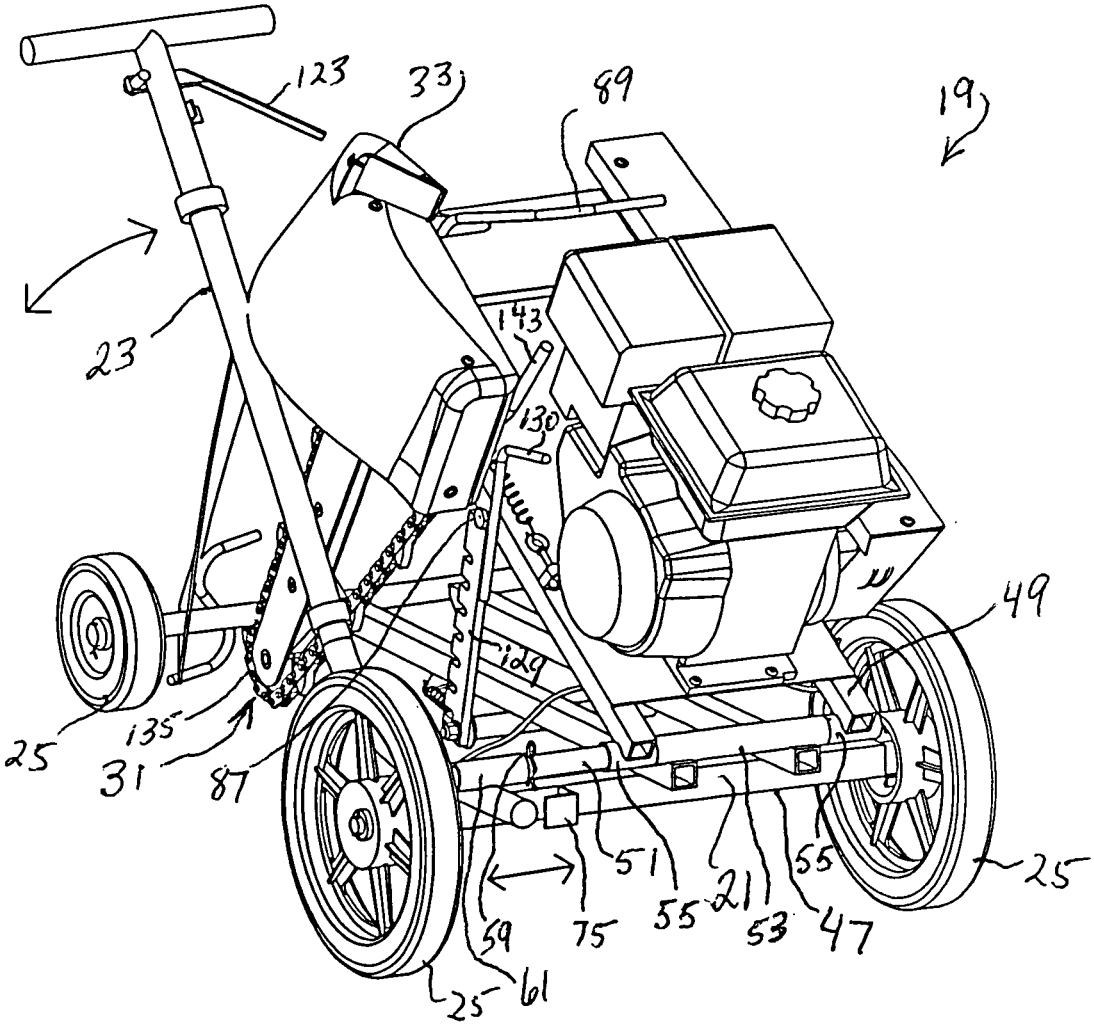

When trenching is completed, drive frame assembly 49 is lifted away from wheel mounting base assembly 77 by an operator grasping hoist handle 89 and pulling while holding support 129 out of engagement with dog 87 by grasping handle 130. When free of the trench, storage support location 133" of support 129 and dog 87 are brought into engagement (see FIGS. 13 and 14). Motor 99 may be stopped at any time. If trenching operations are completed, handle bar 23 may then be release from retaining clip 75 by removal of cotter pin 59 and laterally sliding bar 23 to the side on its journal 61 on shaft 51 and then replacing cotter pin 59. Handle 23 in then freely pivotable on shaft 51 to relocate it in its stored position as shown in FIG. 15 for transport and storage.

As may be appreciated from the foregoing, the trencher of this invention is highly maneuverable in small and/or crowded work areas, requires very little operator training for safe use, and facilitates on-site maintenance. The trencher is highly compact for transport and storage, thus requiring little or no extra gear or facilities. The trencher may utilize any known power source for chain drive. While belt and pulley power transfer is taught herein, other known power transfer systems such as chain/sprocket/clutch, hydraulic pump drive, speed control/centrifugal clutch systems, or the like could be utilized. Alternative trenching depth adjustment systems could also be employed, such as screw/crank systems, gear and rack systems, hydraulic or pneumatics systems, or others. While an articulated handle bar is shown, removable or foldable handle bar systems could be utilized. Instead of relying solely on operator propulsion, belt or chain drive/clutch systems could be provided to transfer drive to one or more of the wheels.

What is claimed is:

1. An operator guided trencher comprising:

a wheeled carriage;

an operator handle bar mounted with said carriage; and a trenching chain assembly mounted at said carriage, said assembly including a chain and a multi-sprocket chain guide, said chain guide including a chain bar and a pivotable sprocket mount pivotably maintained at said carriage and having a first idler sprocket rotatably mounted thereon, a biasing spring connected between said pivotable sprocket mount and said carriage, said chain bar having second and third sprockets mounted adjacent to opposite ends thereof in a fixed relationship, one of said second and third sprockets being driven, said first idler sprocket of said chain guide thus pivotable relative to said carriage on said pivotable sprocket mount both against bias of said spring and under the influence of bias of said spring toward and away from, respectively, said chain bar to tension said chain during chain use while also allowing said sprocket to pivot to thereby partially relieve chain tension during chain use in case of debris entrainment adjacent to said chain.

2. The trencher of claim 1 wherein said pivotable sprocket mount of said chain guide includes a manually actuatable handle allowing operator movement of said first sprocket against bias for additional control of chain tension relief.

3. The trencher of claim 1 wherein said chain bar includes a center chain guide plate between sprocket mounting plates to minimize debris entrainment at said chain and said chain guide during trenching operations.

4. The trencher of claim 1 wherein said trenching chain assembly further includes a chain drive motor associated with said driven one of said second and third sprockets.

5. The trencher of claim 4 wherein said handle bar is mounted rearward at said carriage and said chain assembly is mounted forward at said carriage, said motor mounted therebetween.

6. The trencher of claim 4 wherein a drive linkage is located at said carriage and associated with said motor and said chain guide, a drive actuator thereof provided for drive engagement and disengagement and having an operator control at said handle bar.

7. A portable trencher comprising:

a carriage including a wheel mounting base assembly and a drive frame assembly pivotably connected to each other adjacent to first ends of each;

a plurality of wheels mounted at said mounting base assembly;

an operator manipulable support connected with one of said mounting base assembly and said drive frame assembly spaced from said first ends thereof and having multiple graduated support locations thereat including a plurality of intermediate support locations for selection of trenching depth and a storage support location at one end thereof, the other of said mounting base assembly and said drive frame assembly having engaging means thereat for association with any operator selected one of said support locations of said support thereby providing operator selection of multiple pivotable locations of said drive frame assembly relative to said wheel mounting base assembly during trencher storage and use;

a trenching chain assembly mounted on said drive frame assembly, said chain assembly including a trenching chain mountable at a chain guide and a chain drive motor operationally associated with said chain guide;

an operator handle bar mounted at said carriage adjacent to said first ends of said mounting base assembly and said drive frame assembly; and a pivot shaft engageable with both said wheel mounting base assembly and said drive frame assembly at said first ends of each and with one end of said handle bar, wherein said handle bar is articulatable on said pivot shaft to thereby provide selective positioning between an operational position and a stored position adjacent to said drive motor.

8. The trencher of claim 7 wherein said drive frame assembly includes a hoist handle for manual lifting by said operator of said drive frame assembly pivotably relative to said wheel mounting base assembly during operator selection of said support locations using said manipulable support.

9. The trencher of claim 7 wherein one of said support and said engaging means includes biasing means for biasing toward engagement with the other of said support and said engaging means.

10. The trencher of claim 7 wherein said chain guide includes chain tension relief means for automatic selective chain tension relief during trenching operations.

11. An operator propelled and guided portable trencher comprising:

a carriage including a wheeled mounting base assembly and a drive frame assembly pivotably connected to each other adjacent to first ends of each;

a trenching chain assembly mounted at said drive frame assembly of said carriage, said trenching chain assembly including a chain and a chain guide, said chain guide having a chain bar and a pivotable sprocket mount with a first sprocket maintained thereat, said chain bar having second and third sprockets mounted adjacent to opposite ends thereof, said sprocket mount pivotably mounted at said drive frame assembly for pivoting movement during trenching operations toward and away from said chain bar and biased to tension said chain during chain use while allowing movement of said first sprocket to partially relieve chain tension during chain use in case of debris entrainment adjacent to said chain; and a handle bar mounted at said carriage adjacent to said first ends of said mounting base assembly and said drive frame assembly.

12. The trencher of claim 11 wherein said handle bar is pivotably mounted for movement between an operational position extending rearward of said carriage and a stored position adjacent to said trenching chain assembly.

13. The trencher of claim 11 wherein said chain assembly is mounted on said drive frame assembly adjacent to an end thereof opposite said first end, said trencher further comprising a motor operationally associated with said chain guide mounted on said drive frame assembly.

14. The trencher of claim 11 further comprising an operator manipulable support pivotably connected with said mounting base assembly at a position spaced from said first end thereof, said support and having a plurality of support locations thereat, said drive frame assembly having engaging means thereat for association with any operator selected one of said support locations of said support.

15. The trencher of claim 14 wherein said support includes a spring mounted to bias said support toward engagement with said engaging means, said drive frame assembly including a hoist handle for operator pivoting of said drive frame assembly relative to said wheel mounting base assembly.

16. The trencher of claim 11 further comprising a motor mounted at said carriage and associated with said chain guide, a drive actuator operationally associated with said motor for drive engagement and disengagement and having an operator control at said handle bar.

17. The trencher of claim 11 further comprising a flexible hood connected with said mounting base assembly and said drive frame assembly and over said chain guide for directing outflow of materials being removed during trenching operations.

* * * * *